US006354982B1

(12) United States Patent
Sencil

(10) Patent No.: US 6,354,982 B1
(45) **Date of Patent: *Mar. 12, 2002**

(54) EXERCISE MACHINE AND METHODS

(75) Inventor: Philip Sencil, Anthony, FL (US)

(73) Assignee: MedX 96, Inc., Ocala, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/412,577

(22) Filed: Oct. 5, 1999

Related U.S. Application Data

(63) Continuation of application No. 09/048,991, filed on Mar. 27, 1998, now Pat. No. 6,004,246.

(51) Int. Cl.[7] ..... A63B 21/00; A63B 21/068; A63B 23/02

(52) U.S. Cl. ..... 482/96; 482/135; 482/142; 482/145; 482/134

(58) Field of Search ..... 482/99–103, 133–138, 482/140, 142, 145, 96; 601/24; 606/237; 297/466

(56) References Cited

U.S. PATENT DOCUMENTS 4,462,252 A * 7/1984 Smidt et al. ..... 482/137
4,621,620 A * 11/1986 Anderson ..... 601/34
4,650,183 A * 3/1987 McIntyre ..... 272/130
4,725,056 A * 2/1988 Rehrl ..... 272/134
5,070,863 A * 12/1991 McArthur et al. ..... 128/25
5,135,457 A * 8/1992 Caruso ..... 482/137
5,324,247 A * 6/1994 Lepley ..... 482/137
5,549,534 A * 8/1996 Parviainen ..... 482/137
6,004,246 A * 12/1999 Sencil ..... 482/96

FOREIGN PATENT DOCUMENTS

SU 843980 * 7/1981 ..... 601/35

* cited by examiner

*Primary Examiner*—Justine R. Yu
*Assistant Examiner*—Victor Hwang
(74) *Attorney, Agent, or Firm*—William E. Mouzavires

(57) ABSTRACT

A lumbar exercise machine having an adjustable pad assembly for engaging the legs above and below the knees while the legs extend generally forward with the feet against a foot rest and the knees bent so that the thighs and calves form an obtuse angle. A lock mechanism is provided to secure the pad assembly in the aforementioned position with the femurs restrained against movement so that the hips, buttocks and thighs cannot move during the exercise. The exerciser then moves his back against a movement arm in opposition to a resistance mechanism connected to the movement arm. The machine is adjustable to properly position a particular user for the exercise. One machine for home use utilizes dead weights plus the user's weight as the resistance mechanism while another machine for commercial use utilizes a compound weight stack as the resistance mechanism.

7 Claims, 8 Drawing Sheets

EXERCISE MACHINE AND METHODS

This application is a continuation of U.S. application Ser. No. 09/048,991, filed Mar. 27, 1998, now U.S. Pat. No. 6,004,246.

OBJECTS OF THE PRESENT INVENTION

The present invention relates to exercise machines and methods for exercising the lower back or lumbar muscles however, they may also be applicable to other muscles of the human body.

One of the objects of the present invention is to provide novel and improved machines and methods for exercising the muscles of the human body such as the lumbar muscles.

Another object of the present invention is to provide novel and improved machines and methods for exercising the lower back muscles while the lumbar muscles are isolated from the muscles in the hips, buttocks and legs. Included herein are novel methods and apparatus for isolating the muscles in the hips, buttocks and legs from the lumbar muscles to enable the lumbar muscles to be exercised without aid or interference from the other muscles.

Another object of the present invention is to provide a machine for efficiently exercising the lumbar muscles and yet is safe and easy to use while also being adjustable to suit the size and other requirements of the user.

A further object of the present invention is to provide a novel machine and method for exercising the muscles which utilizes the exerciser's own weight as a resistance.

Another object of the present invention is to provide a machine for exercising the lumbar muscles incorporating a novel transmission for transferring movement between a movement arm and a resistance which opposes the movement arm.

A further object of the present invention is to provide a machine for exercising the lumbar muscles that may be manufactured in several forms to suit commercial use in fitness or exercise centers or use in the home.

SUMMARY OF THE INVENTION

The present invention in its preferred forms provides a machine and method for exercising the lumbar muscles while the user is seated with his hips firmly engaged against a hip pad at the rear of the seat, and with the legs extending generally forwardly but bent at the knees so that the thighs and calves form an obtuse angle between them preferably about 120 degrees. It is also preferred that the feet be positioned on a leg rest extending generally vertically but at an angle to the horizontal. In accordance with the present invention, a leg pad assembly is pivotally mounted over the knee area so that it may be easily adjusted to secure pads with generally equal force on the legs on opposite sides and adjacent to the knees while leaving the knees free of engagement by the pads and free of shear forces and other pressure that could injure the knees. Once adjusted as desired, the pad assembly is locked into position to immobilize the legs, hips and buttocks so that when the exerciser moves a movement arm on the machine, the lumbar muscles are exercised without participation of the muscles in the legs, hips and buttocks. Other features of the present invention are described in the detailed description below.

DRAWINGS

Other objects and advantages of the present invention will become apparent from the following, more detailed description taken in conjunction with the actual drawings in which.

DETAILED DESCRIPTION

Figure 1:
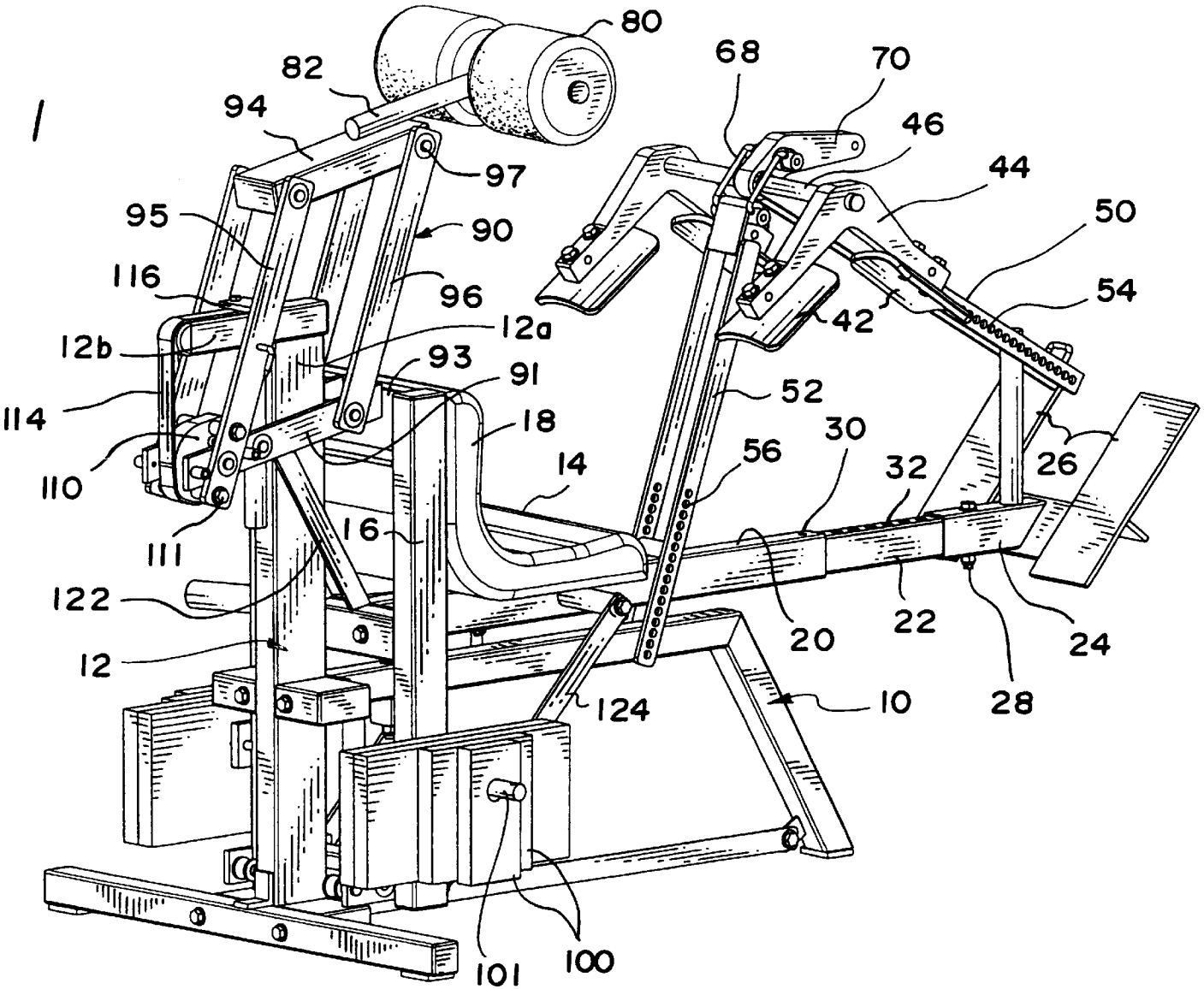
FIG. 1 is a perspective view of a lumbar exercise machine constituting one preferred embodiment of the present invention particularly suitable for home use and shown in an "exercise-start" position.

Referring now to the drawings in detail there is shown in FIGS. 1 through 6, for illustrative purposes only, a first preferred embodiment of a lumbar exercise machine of the present invention particularly suitable for use in the home although of course, it need not be limited thereto. Referring to FIG. 1 the machine includes a front and rear interconnected frame portions 10 and 12 which may be made of any suitable construction, for example, structural steel or alloy tubing. A seat 14 is fixed to vertical frame portions 16 and includes a hip support portion 18 at the back for supporting the hips of the user during an exercise as will be described in more detail. The front frame includes an upper frame comprised of an elongated tube 20 receiving a second tube 22 in telescoping relationship to allow the later to be adjusted in the former to suit the size of a user of the machine. Tube 22 is received in another tube 24 to which is fixed a pair of foot rests 26 which extend upwardly at acute angles for receiving the feet of the user to support the legs during an exercise as will be further described. Tube 24 is secured to tube 22 by a suitable fastener such as the nut and bolt 28 shown. Telescoping tube 22 is secured in tube 20 by means of a pin (not shown) received through an aperture 30 in tube 20 and a selected aperture 32 in tube 22, there being a series of apertures spaced along tube 22 as shown in FIG. 1.

Figure 5:
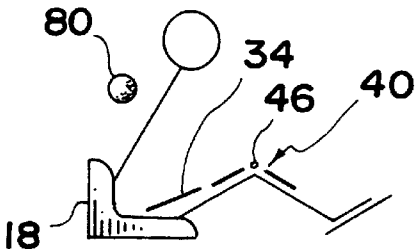
FIGS. 5 and 6 are side views illustrating portions of an exerciser at the "exercise-start" position and "exercise-finish" position respectively.
Figure 6:
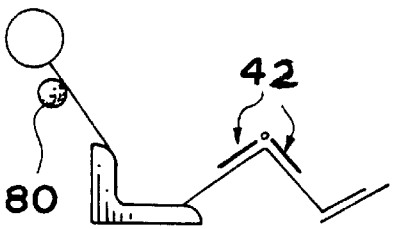

In accordance with the present invention, a leg and knee restraint assembly generally designated 40 is provided for securing the user in the machine with his hips, buttocks and legs immobilized to isolate the lumbar muscles from the muscles in the hips, buttock and legs. The user is positioned as shown in FIG. 5 with the hips firmly secured against the hip rest 18 at the back of the seat and with the legs extending generally forward but bent at the knees so that an angle of approximately 120 degrees is formed by the calves and thighs. In this position, the femurs, represented by the numeral 34 in FIG. 5 extend rearwardly and downwardly and are immobilized by the restraint assembly 40. Immobilization of the femurs prevents rotation of the hips (pelvis) since the femurs are connected to the hips; this in turn prevents movement of the buttocks and thighs. The legs are also positioned and restrained by means of foot rests 26 which receive the feet at an angle to the horizontal as shown in FIGS. 1,5 and 6.

The leg restraint assembly 40 includes in the preferred embodiment, two pairs of leg pads for respectively engaging the legs above and below the knees with equal force being transmitted to the legs but not the knees which remain free of contact with the pads 42 and with no shear forces or other forces that could cause injuries to the knees. In the specific embodiment shown, pads 42 are fixed to mounting arms 44 which in turn are mounted for rotation on a shaft 46.The pivotal movement of pads 44 allow them to self adjust to the legs of a particular user so that equal forces on opposite sides of the knees are imposed on the legs and the knees are not subject to any shear forces or differential pressure or forces on opposite sides thereof that could cause injury to the knee.

Figure 3:
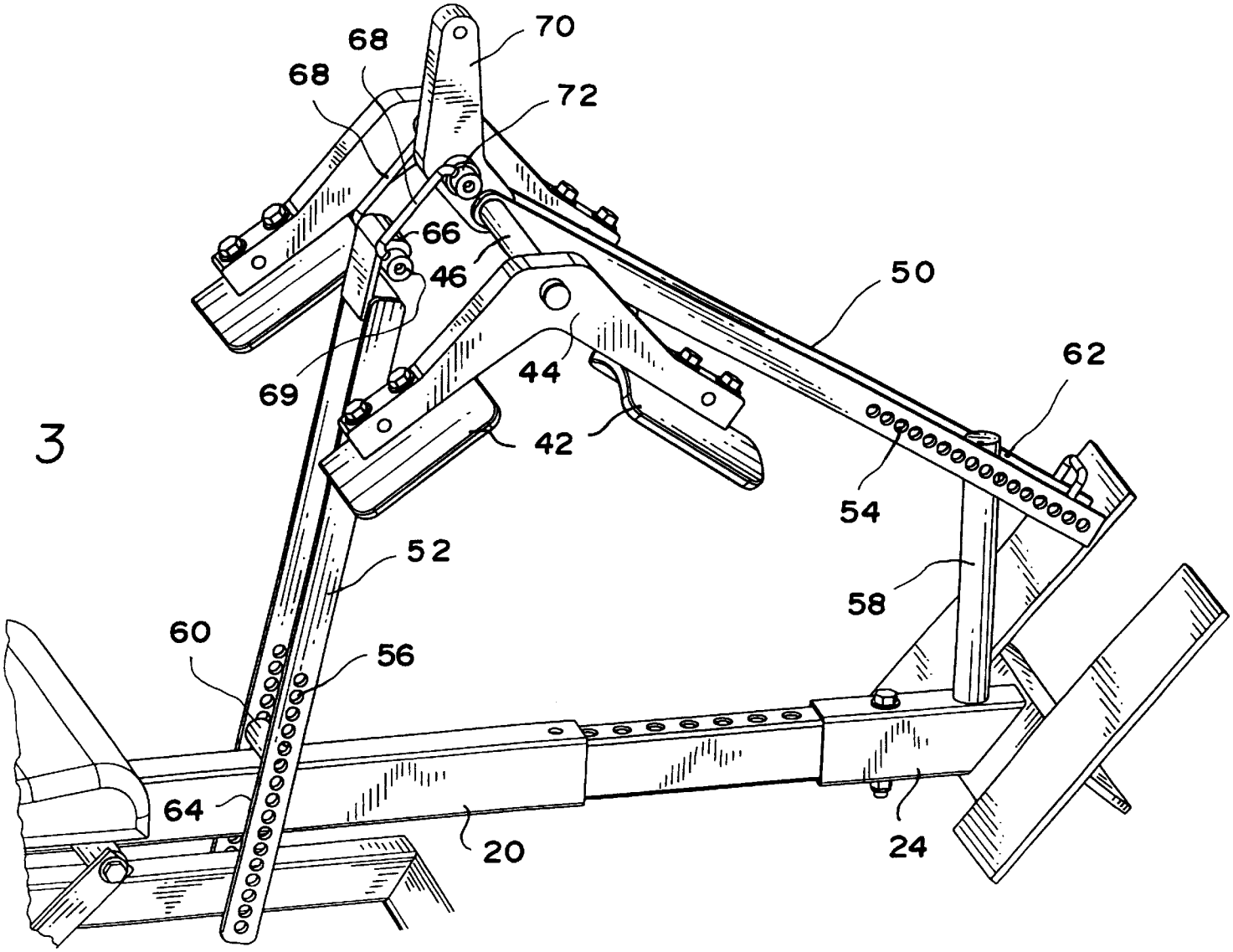
FIG. 3 is a perspective view of a portion of the machine shown with a lock mechanism in an open position.

The position of pads 42 along the front frame is adjustable as will now be described. In the specific embodiment shown in FIGS. 1 and 3, the leg pads 42 are mounted to the frame of the machine by distal and proximal support members 50 and 52 which are adjustably mounted to the front frame portion by means of apertures 54 and 56 spaced along the support members 50 and 52. Distal support member 50 is mounted to a post 58 upstanding from frame tube 24. A locking pin, not shown in FIG. 3, is inserted through one of the apertures in the support member 50 and into an aperture in the post 58 to pivotally mount the support member 50 to the front frame. Similarly the proximal support member 52 is mounted to frame tube 20 by a lock pin receive in one of the apertures 56 and through a tubular receptacle 60 fixed to frame tube portion 20. In the specific embodiment shown, the distal and proximal supports 50 and 52 include opposite side portions 62 and 64 spaced from each other to straddle the post 58 and frame tube 20, however, any other suitable structure may be utilized. It will be seen that by adjusting the support members 50 and 52 along the front frame, the position of the leg pads 42 may be adjusted to the particular size of the user.

The distal and proximal support members 50 and 52 are secured and locked together, by any suitable securement or locking means which in the shown embodiment of FIGS. 1 to 6 includes a receptacle in the form of a hooked shaped member 66 fixed to the upper end of the proximate support member 52 and a buckle including two links 68 and a cross piece 69 fixed to the links to be receivable in the hook 66 of the proximate member 52 as best shown in FIG. 3. To lock the support members 50 and 52 together in the desired position of the pad assemblies 40 on the exerciser's legs, the shown embodiment utilizes an over center mechanism including a lever 70 rotatably mounted on shaft 46 and receiving the ends of buckle links 68 which are mounted in a bearing 72 received in lever 70 as best shown in FIG. 3. The open position of the lock mechanism is shown in FIG. 3. To close the lock mechanism to secure the support members 50 and 52 in the desired position, lever 70 is rotated clockwise as shown in FIG. 3 to move the lever and links past center into the position shown in FIG. 1 which position is limited and defined by engagement of the buckle links 68 with the shaft 46. In this position, the distal and proximal support members 50 and 52 are fixed to the front frame portion and the pads 42 are firmly engaged above and below the user's knees while the feet are supported on the foot rest 26. Also, the hips of the user are firmly engaged against the hip pad 18 as best shown in FIG. 5 In this position, the user cannot move his hips, buttocks or legs to frustrate the exercise of the lumbar muscles.

The exercise is performed by the user engaging a movement arm with the back to first move it rearwardly against the opposition of a suitable resistance, preferably one or more weights. During this phase, the user performs positive work. The user then returns to the starting position as the weight returns to its starting position during which phase the user is performing negative work. The exercise is repeated until the desired amount of exercise has been achieved. In the preferred embodiment shown, the movement arm includes a resistance pad 80 mounted on a linkage mechanism generally designated 90 and including a mounting link 91 fixed to the seat frame portion 93 and projecting rearwardly therefrom as shown in FIG. 1. Opposite mounting link 91 is a link 94 to which the resistance pad 80 is secured by a rod 82 welded to link 44 or in any other suitable way. The linkage is completed by parallel links 95 and 96 which together with links 91 and 94 form a four bar linkage, it being understood that all of the links are interconnected by pivot pins one being shown at 97. In the specific embodiment shown two sets of linkages are provided.

Figure 2:
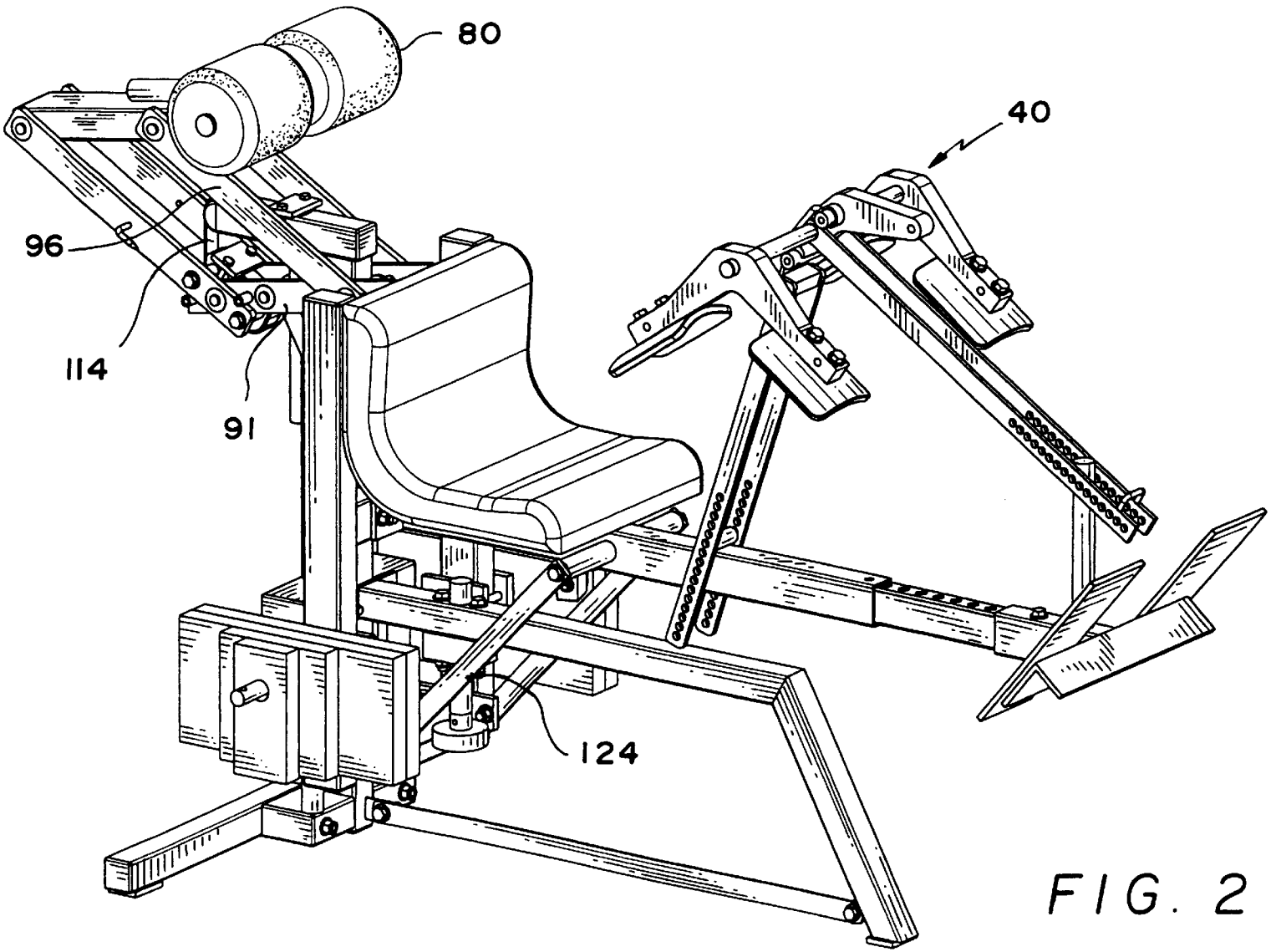
FIG. 2 is a view generally similar to FIG. 1 but with the machine in an "exercise-finish" position.
Figure 4:
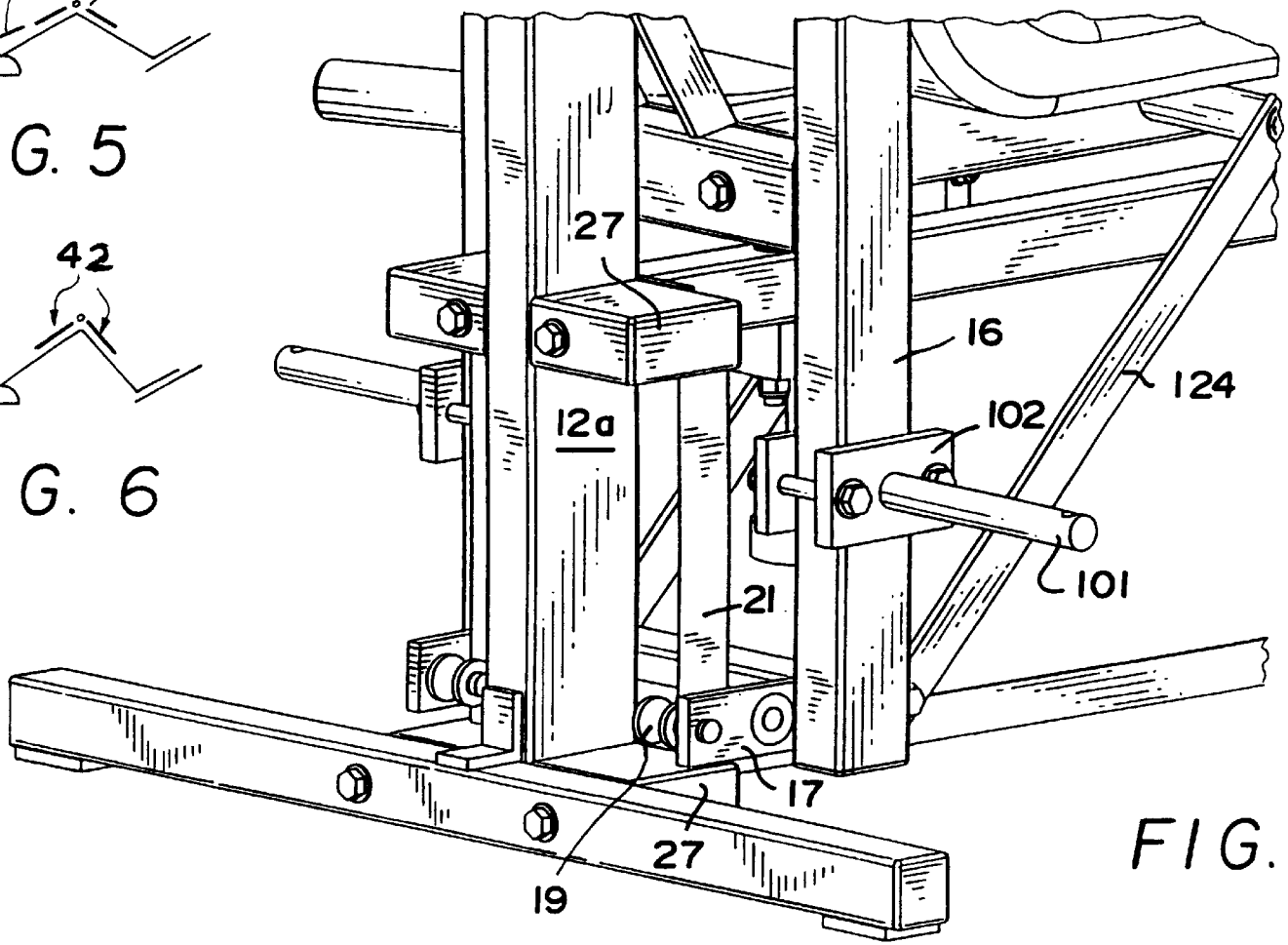
FIG. 4 is a perspective view of a lower, rear, frame portion of the machine.

During an exercise, the linkage 90 is moved from a position shown in FIG. 1 to a position shown in FIG. 2 against a resistance including one or more dead weights 100 mounted on bars 101 fixed to the seat frame legs 16 as shown in FIGS. 1 and 4. In the specific embodiment shown in FIG. 4 the rod 101 is fixed to frame leg 16 by a clamp 102, however, any other suitable means may of course be employed. In addition to dead weights 100, the resistance to the exercise is also provided by the user's own body weight. This is effected by a mechanism which causes the seat 14 and its frame 16, 93 to rise when the linkage is moved from the position of FIG. 1 to the position of FIG. 2.

In the preferred embodiment, this mechanism includes a cam 110 connected to link 95 by bolts 111 to rotate with it as the linkage 90 moves between the positions shown in FIGS. 1 and 2. Cam 110 has fixed to its peripheral surface, one end of a belt 114 whose opposite end is fixed by the bolt and plate fastener 116 to the vertical frame post 12*a* which includes an overhang portion 12*b* to which belt 114 is fixed and around which the belt is trained as shown in FIG. 1. When the linkage 90 is moved to the position shown in FIG. 2 the belt 114 will wrap around cam 110 and cause the linkage 90 and seat 14 and seat frame 16 to vertically rise under the guidance of rolls 19 (see FIG. 4) which will move along guide rails 21 fixed to flanges 27 in parallel to vertical frame post 12*a*. Flanges 27 are fixed to the frame including post 12*a* as shown in FIG. 4. In the specific embodiment shown support members 122 are fixed to the seat frame and extend upwardly to abut link 91 of the four bar linkage 90 as shown in FIG. 1. Also the front frame 20 is braced by support bars 124 which are anchored at the base frame.

To use the machine the user sits and places the hips against the hip pad 18 with his legs bent at approximately 120 degrees between the calves and the legs. The pad assembly supports 50, 52 are adjusted along the front frame to position the knee pads 42 equally on opposite sides of the bent knees so that the knees are free of any stress and are not engaged by pads 42. Support members 50, 52 are locked in position by inserting pins through apparatus 54,56. The lever 70 is then rotated clockwise as viewed in FIG. 3 to lock the support members 50, 52 and pads 42 in the desired position.

The user then moves from the start position shown in FIG. 5 to the finish position shown in FIG. 6 during which time positive work is performed to lift the seat 14 including dead weights 100 from the position shown in FIG. 1 to that of FIG. 2. The user then returns to the start position and repeats the exercise as desired. During the exercise the hips of the user cannot move because of the restraint on the femurs and other leg parts provided by the pad assembly 40 in cooperation with the seat and hip pad 18 and the foot rest 26. The result is efficient exercise of the lumbar muscles as there is no assistance from the muscles in the buttocks, thighs and legs. When the exercise is concluded, the lock lever 70 is rotated counter clockwise to release the legs from the pad assembly 40. The support 52 may also be detached from support 50 by unhooking buckle 68, 69 from hook 66. The above machine not only provides efficient exercise of the lumbar muscles, it also allows the resistance value to be accurately determined since the resistance including seat and seat frame 14, 16 and weights 100 move in a generally linear fashion rather in angular motion.

Referring now to FIGS. 7 through 12, there is shown for illustrative purposes another lumbar exercise machine constituting another preferred embodiment particulary suitable for commercial use such as exercise or fitness centers or clinics etc. This machine employs a knee and leg restraint generally designated 134 which is similar to that described above in connection with the machine disclosing FIGS. 1 through 6. However in the present machine, the pad supports 150, 152 are pivotally interconnected by link 172 (see FIG. 11) rather than hook and buckle described in the embodiment of FIGS. 1 through 6. A lock mechanism having a handle lever 170 is included in the present pad assembly for locking the pad supports 150, 152 in the desired adjusted position. Pad support 152 in the presently described embodiment also includes a counter weight 133 fixed at the lower end thereof to counterweight the restraint pad assembly to facilitate movement thereof.

Figure 10:
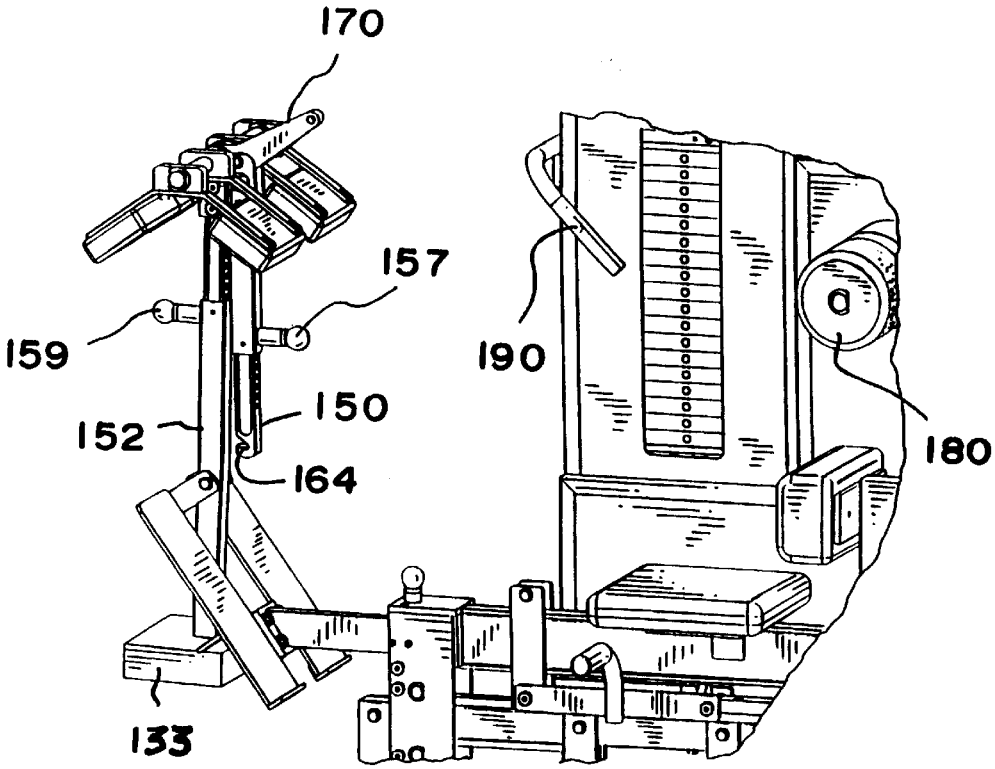
FIG. 10 is a side perspective view of the machine shown with a knee and leg restraint in a retracted position allowing entry by a user.
Figure 11:
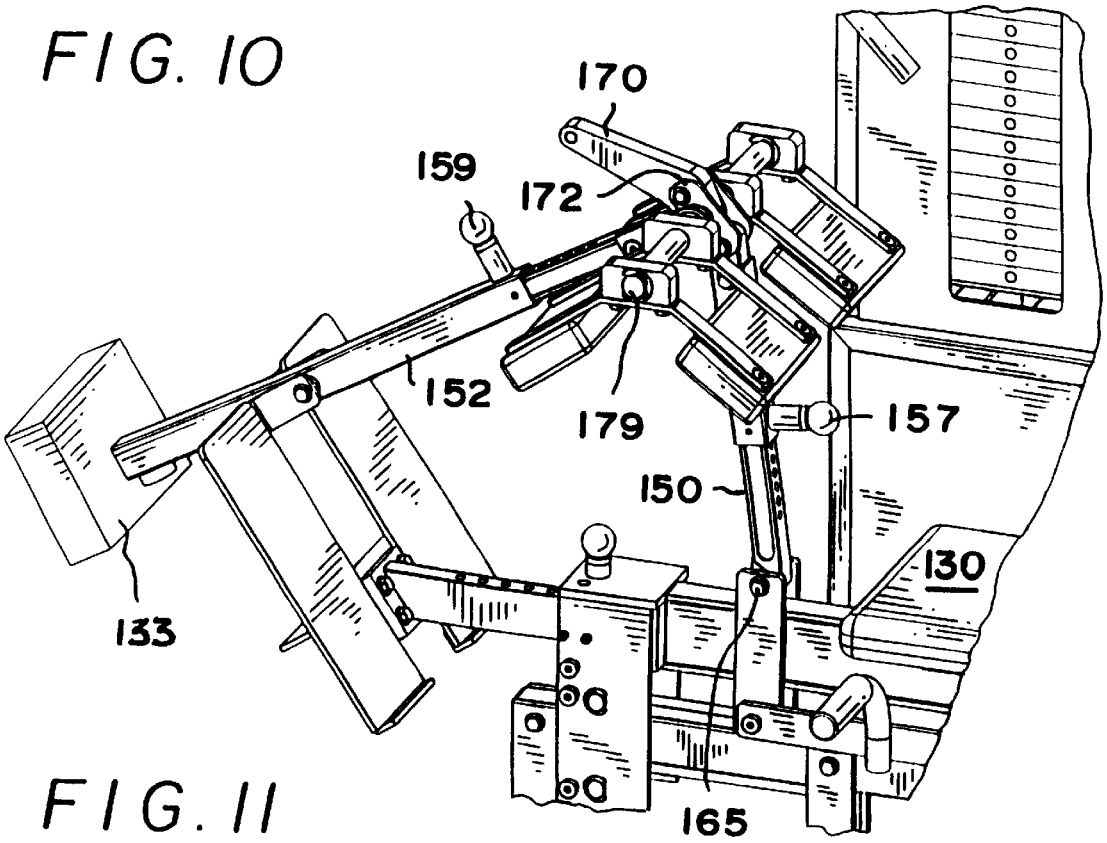
FIG. 11 is a view generally similar to FIG. 10 but shown with the knee and leg restraint locked in position for exercise.

Referring to FIG. 10, the pad support 150 has at its lower end a hook 164 for connecting support 150 to a seat frame as shown in FIG. 11 where a pin or a rod 165 is shown for receipt in hook 164. Supports 150,152 may be provided with handles 157, 159 to manipulate movement of them between operative and idle positions. FIG. 10 shows an idle position where support 150 is removed from the seat frame and folded downwardly to lie adjacent support member 152 at the forward end of the machine allowing easy access to the machine as well as easy exit.

Figure 7:
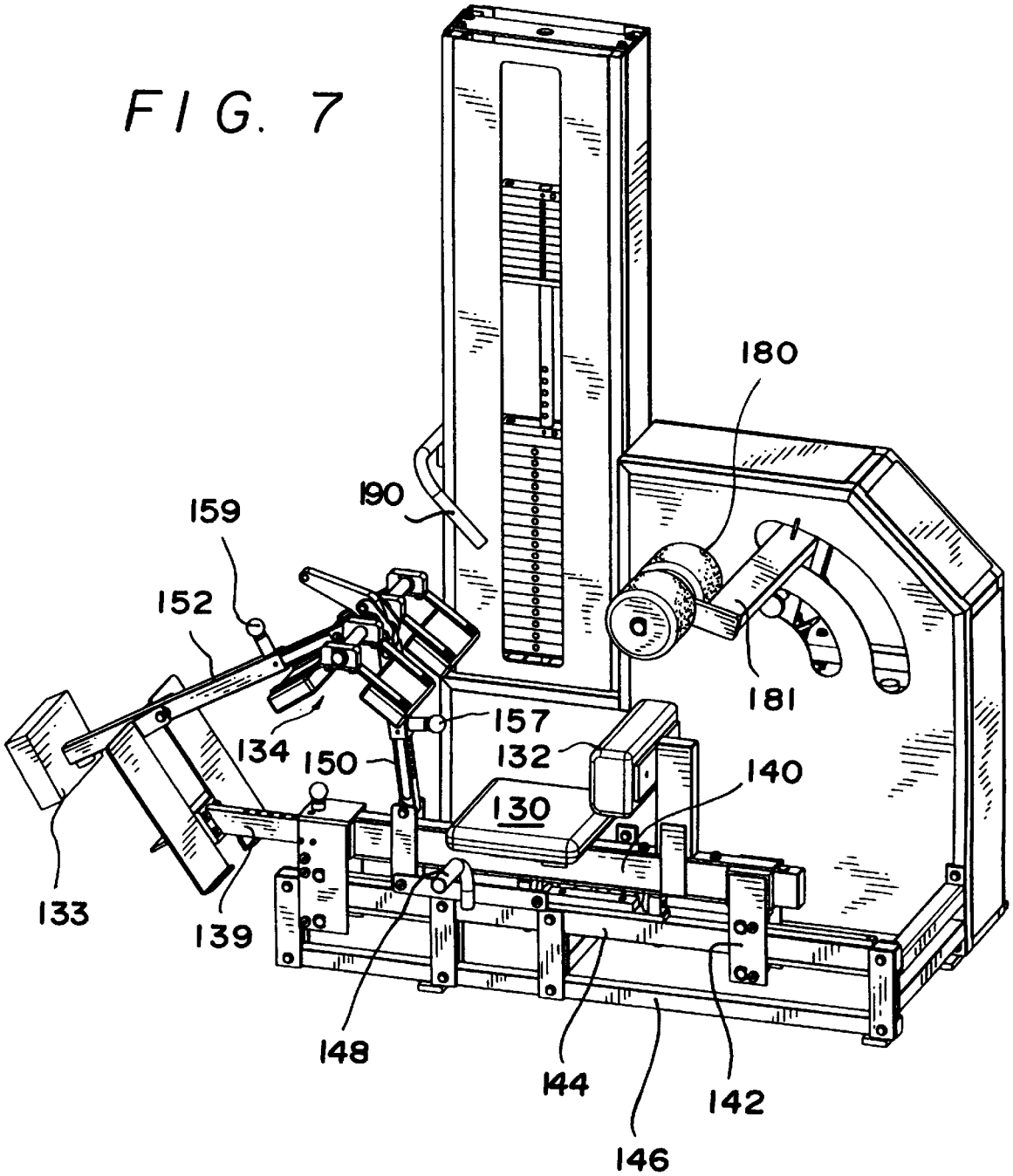
FIG. 7 is a perspective, side view of another lumbar machine constituting another preferred embodiment of the present invention particularly suitable for commercial use.
Figure 9:
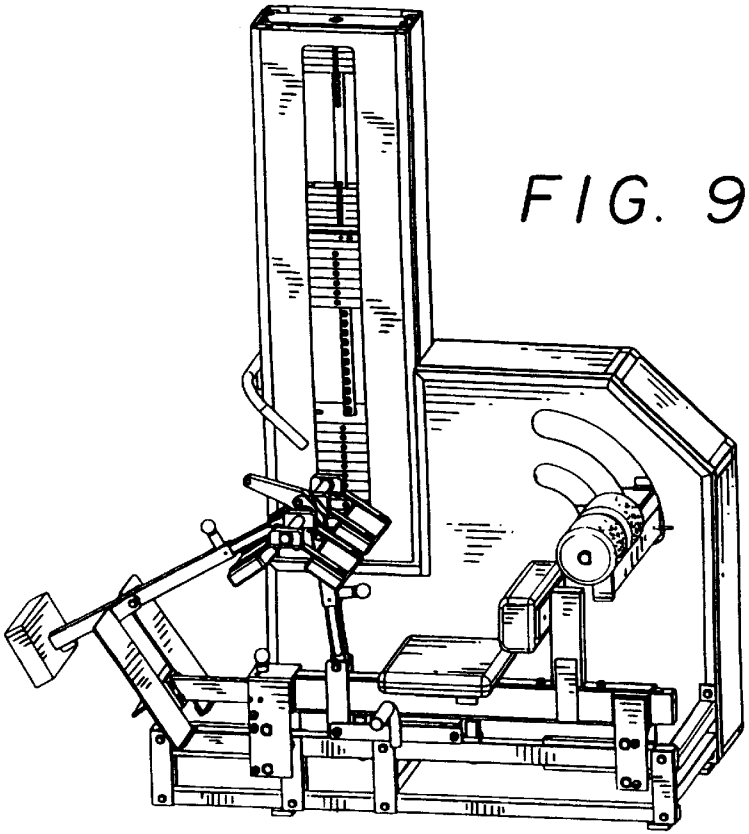
FIG. 9 is a view generally similar to FIG. 8 but with the movement arm in an extended position obtained by the user moving his back rearwardly against the movement arm.
Figure 8:
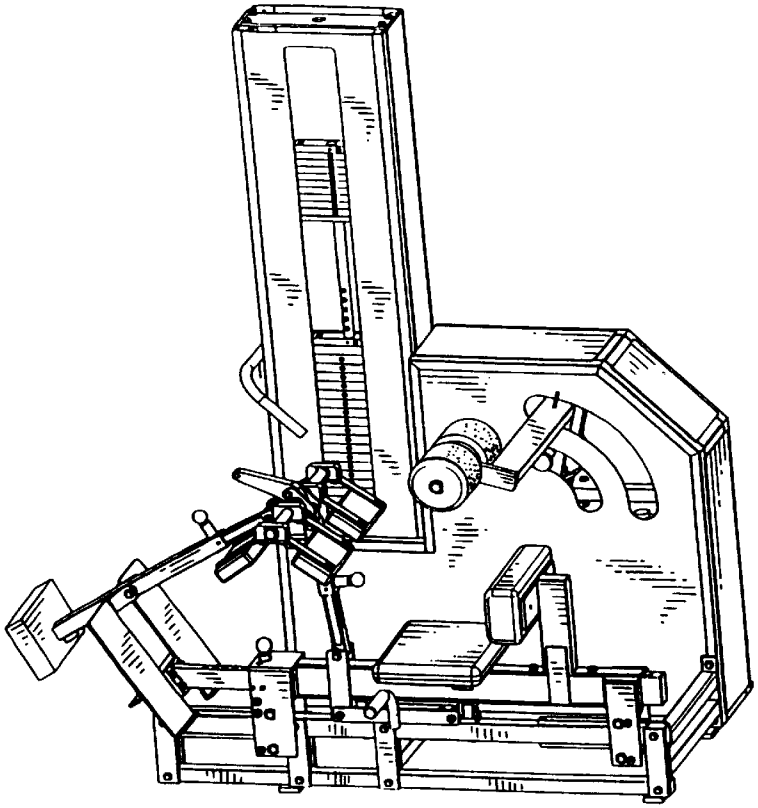
FIG. 8 is a view generally similar to FIG. 7 but with the seat frame in position ready for exercise.

Referring to FIG. 7, a seat 130 for the user is fixed to a seat frame 140 which is mounted for longitudinal slidable movement on an underlining frame 144 which in turn is supported by a base frame 146. Seat frame 140 is provided with trolleys 142 mounted on frame 144. The hip pad shown at 132 which is fixed at the rear of the seat to the seat frame at 140. Once the user is properly positioned with respect to the resistance pad 180 of the movement arm, the seat and seat frame 140 are locked in that position by a lock mechanism operated by a handle 148 at the side of the seat shown in FIG. 7. A handle 190 is provided to help the user slide the seat 130 into the desired position. In the presently described embodiment, the seat 130 and hip pad 132 do not rise as part of the resistance mechanism during the exercise. Instead, a compound weight stack including upper and lower independently operable weight stacks 196,195, is utilized to provide the resistance to movement of the movement arm by the user during an exercise. A more detailed description of the compound weight stack may be found in U.S. Pat. No. 4,834,365 which is incorporated by reference herein.

Figure 12:
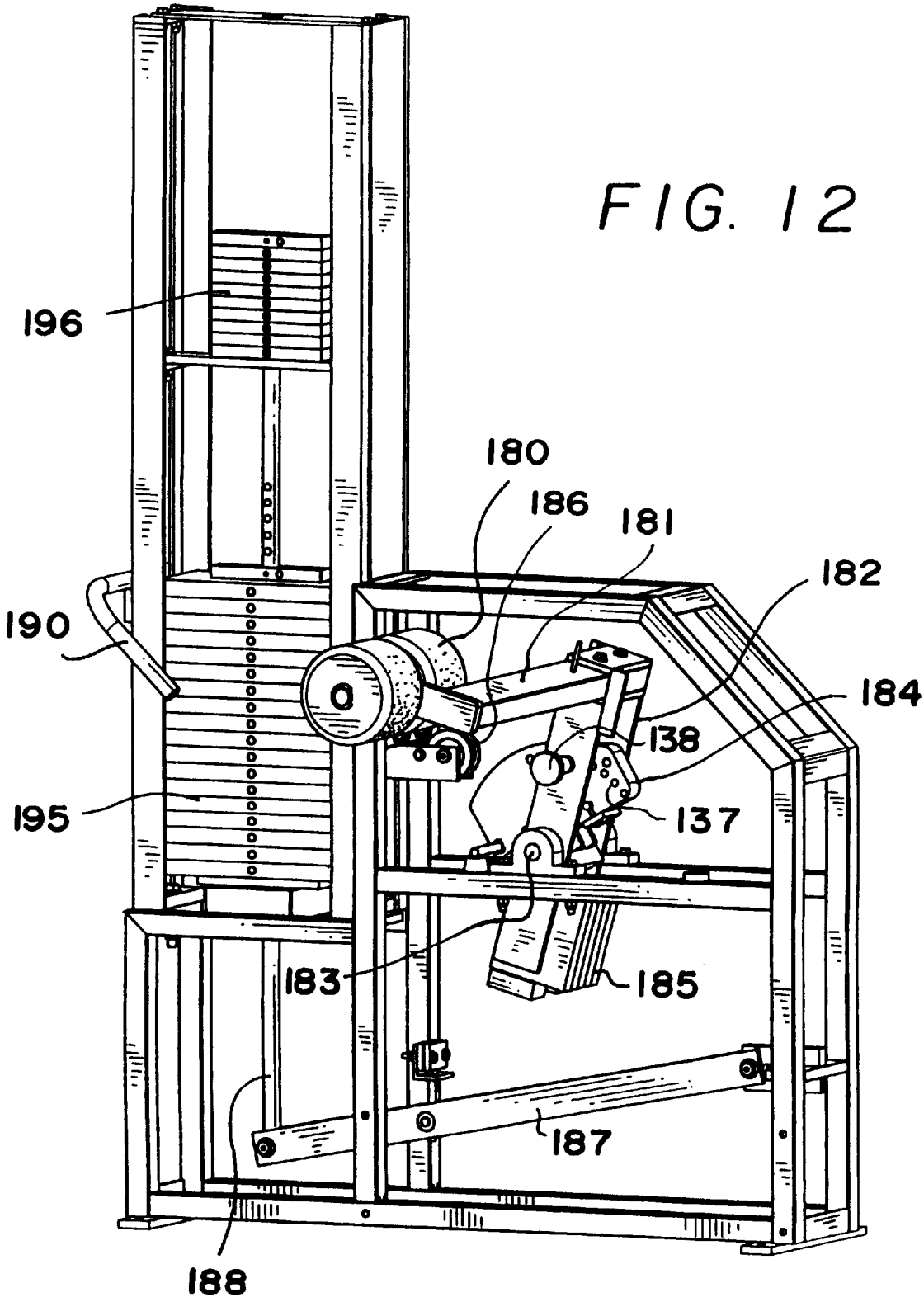
FIG. 12 is a side perspective view of the machine but with parts removed and showing a cam and lever transmission between the movement arm and a weight stack.

The movement arm includes resistance pad 180 engageable by the back of the user, a yoke type arm 181 fixed to pad 180 extending transversely of the longitudinal direction of the seat frame and a vertically extending arm portion 182 best shown in FIG. 12. The movement arm is mounted for rotation about a generally horizontal axis shown at 183 by a shaft mounted in bearing blocks (see FIG. 12) and it is balanced by weights 185 secured to the lower end of the movement arm as shown in FIG. 12.

Transmission of movement from the movement arm 180, 182, to the weight stack during the exercise is achieved by a cam 184 fixed to the movement arm portion 182 as shown in FIG. 12 so as to rotate with the movement arm. A pulley cable or belt (not shown) is fixed to the cam 184 and extends about pulley 186 and then downwardly to a lever 187 located in the bottom of the frame below the weight stack and the movement arm. In the preferred embodiment, the cam 184 may be adjusted relative to the movement arm 182 to change the resistance characteristics and range of movement, there being shown in FIG. 12 a pin 138 mounted in arm portion 182 to be received in one of the apertures 137 to effect the adjustment. Movement of the movement arm is transmitted through the cam to the lever 187 which in turn is pivotally connected to the lower end of the weight stack pin 188 for raising the weight stack pin when the movement arm is moved from the start to the finish position causing one or more of the weight stack weights which are connected to the pin 188 to move upwardly with the pin.

In operation, entry to the machine by a user is effected when the support arms 150,152 of the knee restraint pads are in the position shown in FIG. 10 for example. The exerciser slides the seat along the seat frame until his upper torso is bent forwardly such as for example shown in FIG. 5. The foot rest frame 139 is adjusted longitudinally while the supports 150,152 are in the position shown in FIG. 10. This is effected through the handles 157, 159. When the knee pads are properly positioned on opposite sides of the knees with their pivot shaft 179 located over the knees, the hook 164 of support member 150 is placed about the pin 165 on the seat frame and then the hand lever 170 is rotated counter clockwise as viewed in FIG. 11 to lock the pads and their support members 150,152 in place to secure the thighs and legs against movement. The user may then proceed with the exercise by moving the resistance pad 180 rearwardly with the user's back to move the resistance pad 180 from the position shown in FIG. 8 to the position in FIG. 9 causing one or more of the weights in the weight stack to be lifted. The user then returns slowly to the start position and repeats the exercise as desired. When the exercise is concluded, the lock lever 170 is rotated towards the knee pads and then the support 150 is unhooked from the seat frame to allow the supports 150,152 to be moved forward to allow easy exit from the machine. The idle position of the supports 150, 152 and the knee pad assembly is easily maintained in a stabilized position by the counterweight 133 as best shown in FIG. 10.

Although preferred embodiments of the invention have been shown and described above, it will be readily appreciated by those of ordinary skill in this art that the invention is not limited to the specific embodiments shown, but rather is covered by the scope of the appended claims.

What is claimed is:

1. A machine for exercising the human body comprising in combination: a movement arm engageable by an exerciser to move the movement arm in one direction, resistance means connected to the movement arm to resist movement in said one direction, a seat for the exerciser during an exercise, and means for preventing movement of the femurs of an exerciser when seated during an exercise including restraint members for engaging the legs of the exerciser above and below the knees, a first support member connected to said restraint members, a second support member mounted to the machine for movement relative to said seat and first support, and releasable securement means for securing said support members together with the restraint members in a desired position, said securement means including a pivotable link interconnecting said support members.

2. The machine defined in claim 1 including foot rests for receiving the feet of an exerciser at an angle to the horizontal, said footrests being adjustable in a generally horizontal plane towards or away from said seat.

3. A machine for exercising the human body comprising in combination: a support frame, a movement arm mounted to the support frame and engageable by an exerciser to move the movement arm in one direction, resistance means connected to the movement arm to resist movement in said one direction, means including a seat for positioning the exerciser during an exercise with the legs extending generally horizontally while being bent at the knees, a restraint mechanism for preventing movement of the legs and pelvis of an exerciser when seated during an exercise with the legs extending generally horizontally including a pair of members for engaging the legs of the exerciser above and below the knees respectively, and being spaced from each other to avoid contact with the knees of the user while engaging the legs of the user on opposite sides of the knees, and a foot rest connected to said frame for receiving the feet of the user at an angle to the horizontal, and means mounting said footrest to the frame for generally horizontal movement towards and away from the seat.

4. The machine defined in claim 1 including pivotable means located between and connecting said members for releasably securing said members in engagement with the legs above and below the knees.

5. The machine defined in claim 4 wherein said members are mounted for pivotable movement to a support member which in turn is mounted to said frame for generally horizontal movement relative to the frame to position said members on the users legs above and below the knees.

6. The machine defined in claim 5 wherein said footrest is connected to said support member for movement therewith in a generally horizontal plane.

7. The machine defined in claim 6 wherein said support member includes a base slidable on a portion of said frame into a desired position.

* * * * *